US005950333A

United States Patent [19]

Tsen

[11] Patent Number: 5,950,333

[45] Date of Patent: Sep. 14, 1999

[54] WATER-PROOF GOLF FOOTWEAR

[76] Inventor: Chin-Yu Tsen, 244, Hsing-Tung Road, Lo-Tung, I-lan, Taiwan

[21] Appl. No.: 09/058,747

[22] Filed: Apr. 10, 1998

[51] Int. Cl.[6] ..... A43B 3/16

[52] U.S. Cl. ..... 36/7.1 R; 36/7.3; 36/7.4; 36/97; 36/127

[58] Field of Search ..... 36/7.1 R, 7.2, 36/7.3, 7.4, 4, 127, 97

[56] References Cited

U.S. PATENT DOCUMENTS

| | | | |
|---|---|---|---|
| 2,032,793 | 3/1936 | Clark et al. | 36/7.4 |
| 2,970,390 | 2/1961 | Brough | 36/7.3 |
| 3,319,362 | 5/1967 | Gomolka | 36/7.3 |
| 4,010,558 | 3/1977 | Slusher | 36/7.3 |
| 4,461,098 | 7/1984 | Diegelman | 36/7.1 R |
| 5,600,901 | 2/1997 | Leonor | 36/7.1 R |

*Primary Examiner*—M. D. Patterson

[57] ABSTRACT

A water-proof jacket having a sole cover or retainer formed on a bottom of the jacket for sealably engaging a sole of a golf shoe and allowing a downward protruding of a plurality of spikes studded on the shoe sole, an upper cover secured on the sole cover having a pair of upper leaves disposed on a right and a left side of the upper cover for covering an upper of the golf shoe by at least a fastener, and a boot portion formed on a rear upper portion of the upper cover for fastening the wearer's ankle or leg portion, with the jacket covering the golf shoe for water-proof purpose for golfing on a wet course.

4 Claims, 4 Drawing Sheets

32
321
3a
311
30
3
31
341
342
35
34
351
352
30'
312
331
3b
33

WATER-PROOF GOLF FOOTWEAR

BACKGROUND OF THE INVENTION

A conventional golf shoe when worn on a golfer may be intruded by moisture or water when the golfer is playing golf in a wet golf course or on a rainy day since the water may penetrate the interior of the shoe especially through an aperture between the shoe upper and the sole, thereby causing uncomfortable feeling for the wearer or moisture corrosion to damage the shoe.

It is then necessary to take off the wet shoe and a rain boot is replaceable for wearing in the wet or water-accumulated golf course, thereby causing inconvenience for the golfer.

The present inventor has found the drawbacks of the conventional golf shoe and invented a water-proof golf footwear suitably worn on a wet golf course.

SUMMARY OF THE INVENTION

The object of the present invention is to provide a water-proof jacket having a sole cover or retainer formed on a bottom of the jacket for sealably engaging a sole of a golf shoe and allowing a downward protruding of a plurality of spikes studded on the shoe sole, an upper cover secured on the sole cover having a pair of upper leaves disposed on a right and a left side of the upper cover for covering an upper of the golf shoe by at least a fastener, and a boot portion formed on a rear upper portion of the upper cover for fastening the wearer's ankle or leg portion, with the jacket covering the golf shoe for water-proof purpose for golfing on a wet course.

DETAILED DESCRIPTION

Figure 1:
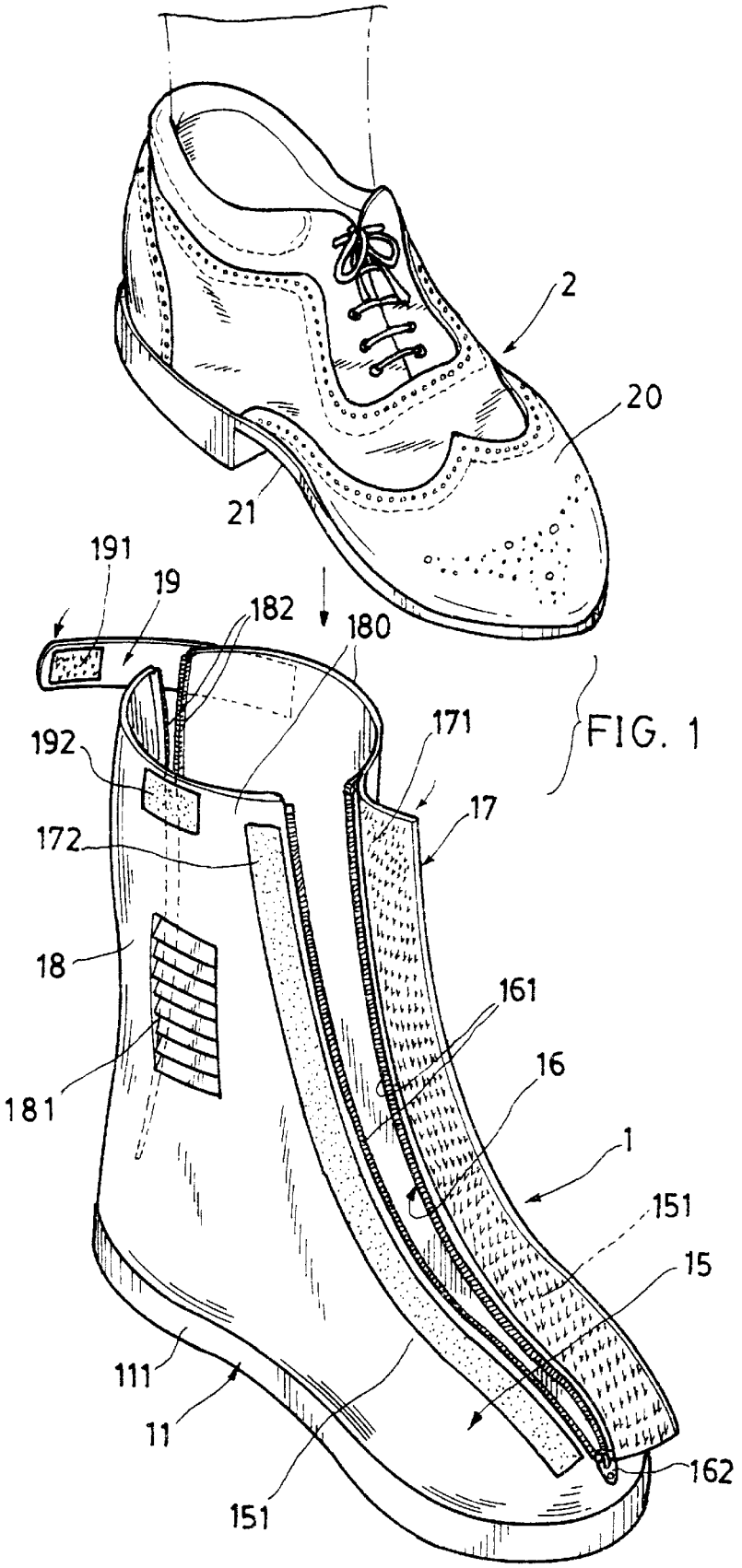
FIG. 1 is an illustration of a golf shoe and a jacket of the present invention.
Figure 2:
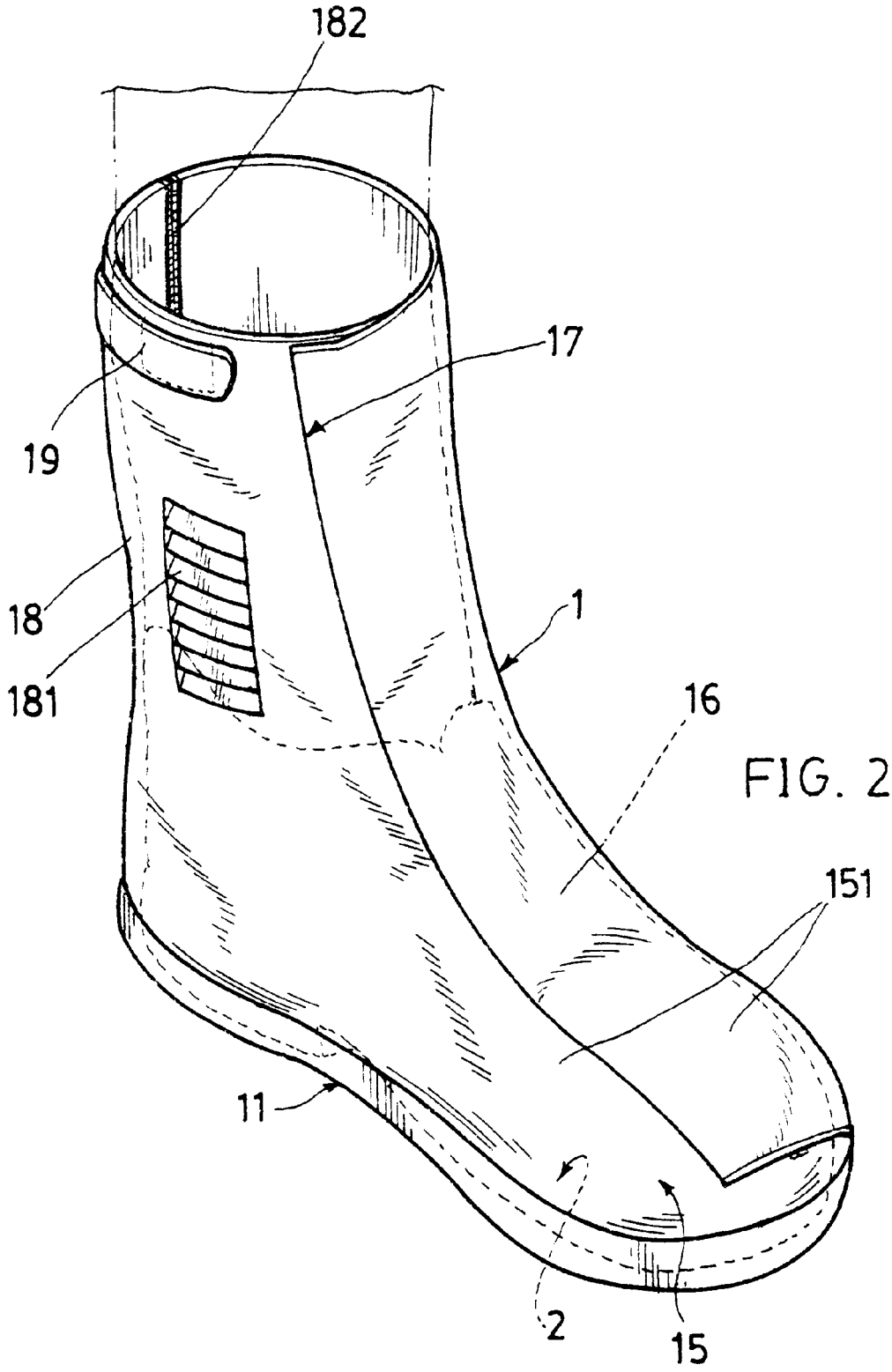
FIG. 2 is an illustration of the present invention as assembled.

As shown in the drawing figures, the water-proof golf footwear of the present invention comprises: a water-proof jacket 1 and a shoe 2 engageable in the jacket 1. The shoe 2 is easily detachable and removable from the jacket 1. The jacket 1 may be made of water-proof elastic materials such as rubber, flexible plastic materials and other suitable materials, not limited in the present invention.

The shoe 2 may be a conventional golf shoe having a plurality of spikes 22 studded on a sole 21 formed on a bottom of the shoe 2 opposite to the shoe upper 20.

The water-proof jacket 1 includes: a sole retainer or cover 11 corresponding to the sole 21 of the shoe 2 for covering the sole 21 having a rim 111 circumferentially disposed around the sole cover 11 for confining a sole rim 210 of the sole 21 of the shoe 2, an upper cover 15 secured to the rim 111 of the sole cover 11 and consisting of two upper leaves 151 disposed on a right and a left side of the upper cover 15 and having at least a fastener 16, 17 for fastening the two upper leaves 151 for fastening an upper 20 of the shoe 2 as worn within the jacket 1, and a boot portion 18 formed on a rear upper portion of the upper cover 15 for covering or protecting a wearer's ankle or leg portion when wearing the shoe 2, with the boot portion 18 openable when unfastening the two upper leaves 151 of the upper cover 15 for removing the jacket 1 from the shoe.

The fastener 16, 17 of the two upper leaves 151 includes a zipper 16 consisting of two rows of fastening teeth 161 disposed on the two upper leaves 151 and a sliding tab 162 for coupling the two rows of fastening teeth 161 for fastening the two upper leaves 151 for covering the shoe 2 within the jacket 1, and a Velcro tape 17 having a hook-threaded strip 171 and a coarse-surface strip 172 respectively formed on each upper leaf 151 of the upper cover 15 and shielding the zipper 16 within the tape 17 for further closing the two upper leaves 151.

The boot portion 18 includes: a pair of boot leaves 180 respectively integrally formed or continuously connected with the two upper leaves 151 of the upper cover 15, with the two boot leaves 180 closed by the fastener 16, 17 on a front portion of the boot portion 18.

The boot portion 18 further includes a Velcro tape (or zipper) 182 formed on a rear portion of the boot portion 18 for closing the rear portion of the boot portion 18 when fastening the Velcro tape 182, and a fastening strap 19 provided on a top portion of the boot portion 18 for fastening a top opening of the boot portion.

The fastening strap 19 includes a male adapter (or a hook-threaded strip) 191 and a female connector (or a coarse-surface strip) 192 engageable and lockable with each other for fastening the top opening of the boot portion 18.

The boot portion 18 is formed with at least a louver or vent 181 for ventilation in the boot portion 18 for comforting the wearer's foot.

Accordingly, the shoe 2 is engaged within the jacket 1 for water-proof purpose by protruding each spike 22 of the shoe 2 through at least a bottom opening of the jacket 1 when golfing in a wet course. The shoe 2 is not removed from the golfer's foot and is directly "worn" into the jacket 1 for a very convenient wearing under water-proof condition. If it is fine, the jacket 1 may then be taken off from the shoe 2 for directly wearing the shoe 2 on a golfer's foot.

Figure 3:
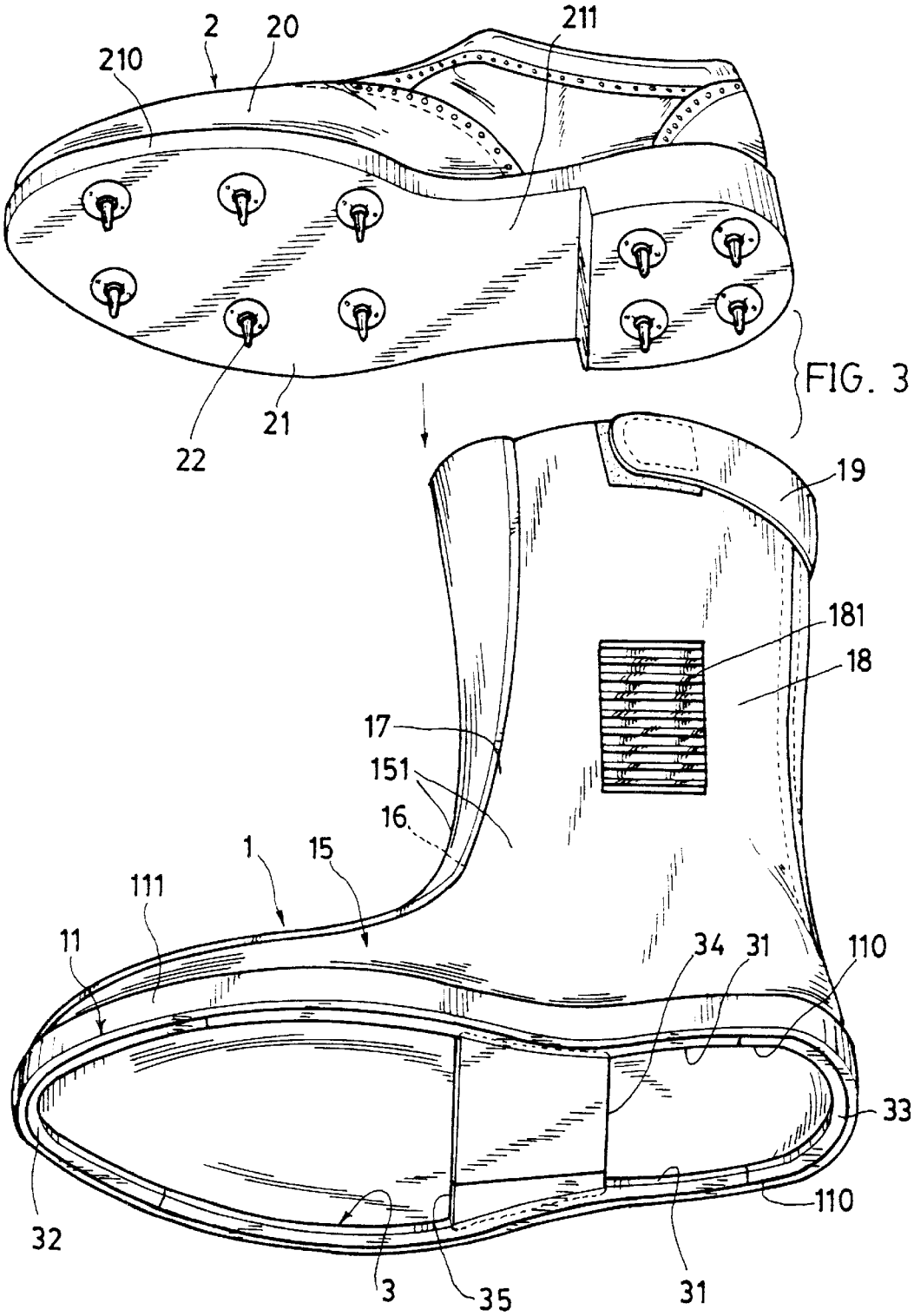
FIG. 3 shows another view of the present invention.

The jacket 1 is formed with a bottom opening 110 within the rim 111 of the sole cover 11 (FIG. 3) and an adjustable frame 3 is embedded or secured in the rim 111 of the sole cover 11.

The adjustable frame 3 as embedded in the sole retainer or sole cover 11 includes: a middle frame section 31 transversely adjustably formed in a middle portion of the adjustable frame 3 and corresponding to a middle sole portion 211 of the shoe 2 without being studded with spikes 22 on the middle sole portion 211; a front rim 32 adjustably connected with a front portion of the middle frame section 31; and a rear rim 33 adjustably connected with a rear portion of the middle frame section 31; a front opening 30 formed in between the front rim 32 and the middle frame section 31 for downwardly protruding a front sole portion studded with spikes 22 of the sole 21 through the front opening 30; and a rear opening 30' formed in between the rear rim 33 and the middle frame section 31 for downwardly protruding a rear sole portion studded with spikes 22 of the sole 21 through the rear opening 30'; and the rim 111 having a packing ring (not shown) circumferentially disposed on an inside wall of the rim 111 slightly above the adjustable frame 3 for sealing an aperture between the rim 111 and the shoe 2 as worn within the rim 111 of the jacket 1 for water-proof purpose.

Figures 4, 5, 6:
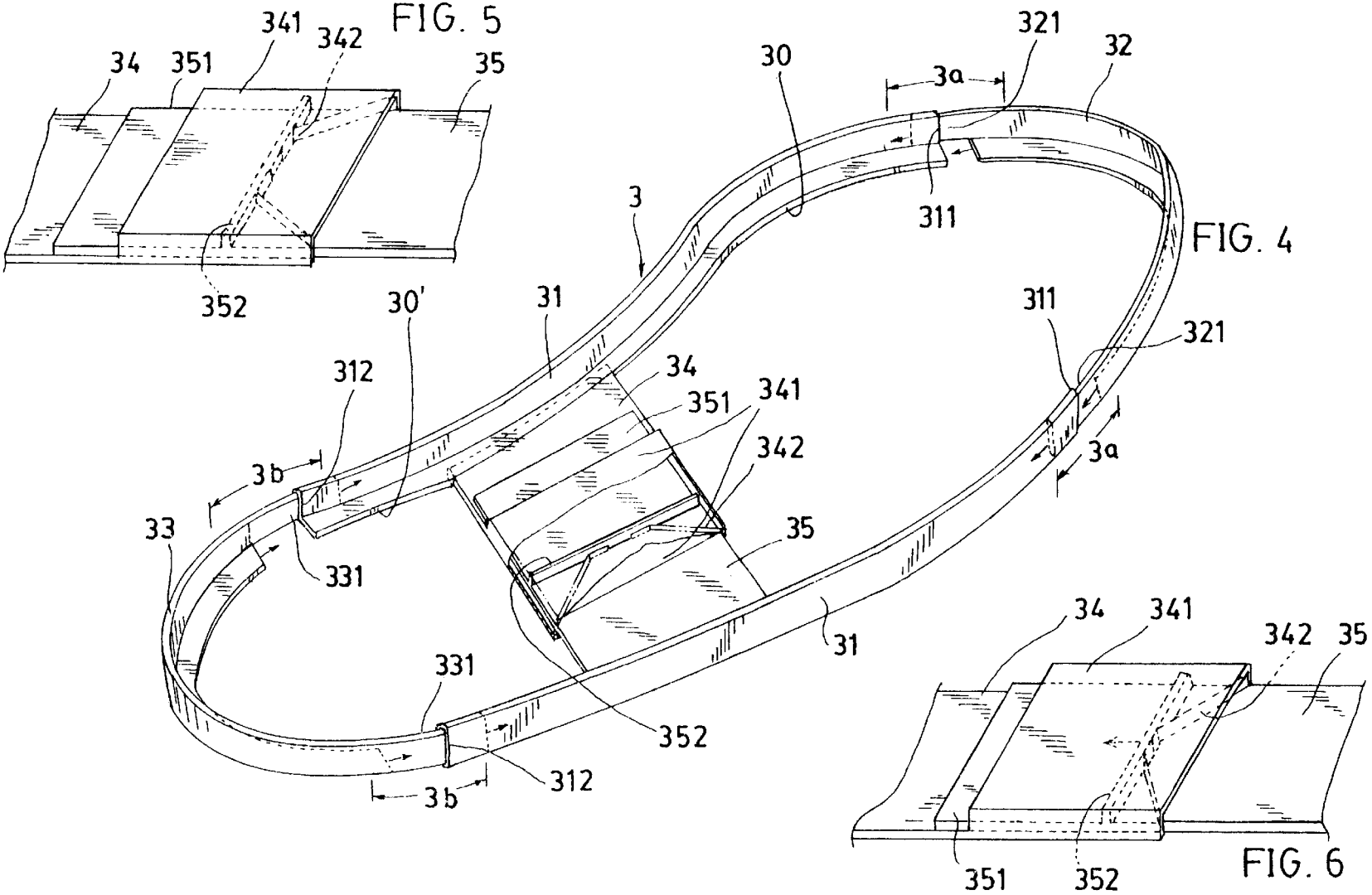
FIG. 4 is a perspective view of an adjustable frame embedded in a bottom of the jacket of the footwear as shown in FIG. 3.
FIG. 5 shows a narrowing adjustment of the adjustable frame of FIG. 4.
FIG. 6 shows a widening adjustment of the adjustable frame of FIG. 4

The middle frame section 31 further includes: an inner sliding plate 34 secured to an inner side of the middle frame section 31 having a sheath 341 and a restoring spring 342 formed on a free end portion of the inner sliding plate 34; and an outer sliding plate 35 secured to an outer side of the middle frame section 31 having a spring retainer 352 formed on a free end portion 351 of the outer sliding plate 35 to be slidably engageable with the sheath 341 on the inner sliding plate 34 with the spring retainer 352 resiliently contacted with the restoring spring 342 for adjusting the width of the middle frame section 31 to conform with a size of the shoe 2 when engaged within the adjustable frame 3 and within the rim 111 of the sole retainer 11 of the jacket 1, with the restoring spring 342 operatively restoring the spring retainer 352 of the outer sliding plate 35 for resiliently holding the shoe 2 within the adjustable frame 3 and the rim 111 of the jacket 1 (from FIG. 6 to FIG. 5).

The front rim 32 includes a pair of front spring legs 321 slidably engageable with two front sleeves 311 formed on two front ends of the middle frame section 31 for a sliding adjustment of the front portion of the adjustable frame 3; and the rear rim 33 includes a pair of rear spring legs 331 slidably engageable with two rear sleeves 312 formed on two rear ends of the middle frame section 31 for a sliding adjustment of the rear portion of the adjustable frame 3 for snugly holding the shoe 2 within the adjustable frame 3 and the rim 111 of the jacket 1. The spring legs 321, 331 have the resilience for clamping the front and rear portion of the shoe within the frame 3.

The adjustable frame 3 is secured in the rim 111 of the jacket 1 by adhesive or by other joining methods, having a "telescopic distance" 3*a* corresponding to a sliding stroke of the front leg 321 in the front sleeve 311 which is not coated with adhesive for allowing a sliding movement of the front leg 321 in the front sleeve 311, and having a rear telescopic distance 3*b* corresponding to a sliding stroke of the rear leg 331 in the rear sleeve 312 which is not coated with adhesive for allowing such a sliding movement of the rear leg 331 in the rear sleeve 312.

By the way, the adjustable frame 3 can be adjusted to conform with the shoe 2 as worn within the frame 3 and the rim 111 of the jacket 1. The rubber or elastic jacket 1 may resiliently restrain the shoe 2 in the jacket 1 for a stable wearing of the shoe 2 within the jacket 1.

The present invention may be modified without departing from the spirit and scope of the present invention.

I claim:

1. A water-proof golf footwear comprising:

a golf shoe (2) having a plurality of spikes (22) studded from a sole (21) of said shoe (2); a water-proof jacket (1) made of water-proof elastic materials and detachably engageable with said shoe (2), said water-proof jack (1) including: a sole retainer (11) corresponding to the sole (21) of the shoe (2) for retaining the sole (21) having a rim (111) circumferentially disposed around the sole retainer (11) for confining a sole rim (210) of the sole (21) of the shoe (2), an upper cover (15) secured to the rim (111) of the sole retainer (11) and consisting of two upper leaves (151) disposed on a right and a left side of the upper cover (15) and having at least a fastener (16, 17) for fastening the two upper leaves (151) for fastening an upper (20) of the shoe (2) as worn within the jacket (1), and a boot portion (18) formed on a rear upper portion of the upper cover (15) for covering a wearer's leg portion when wearing the shoe (2), with the boot portion (18) openable when unfastening the two upper leaves (151) of the upper cover (15) for removing the jacket (1) from, the shoe (2); and an adjustable frame (3) embedded in the sole retainer (11') including: a middle frame section (31) formed in a middle portion of the adjustable frame (3) and corresponding to middle sole portion (211) of the shoe (2) without being studded with spikes (22) on the middle sole portion (211); a front rim (32) connected with a front portion of the middle frame section (31); and a rear rim (33) connected with a rear portion of the middle frame section (31); a front opening (30) formed in between the front rim (32) and the middle frame section (31) for downwardly protruding a front sole portion studded with spikes (22) of the sole (21) through the front opening (30); and a rear opening (30') formed in between the rear rim (33) and the middle frame section (31) for downwardly protruding a rear sole portion studded with spikes (22) of the sole (21) through the rear opening (30'); and the rim (111) having a packing ring circumferentially disposed on an inside wall of the rim (111) slightly above the adjustable frame (3) for sealing an aperture between the rim (111) and the shoe (2) as worn within the rim (111) of the jacket (1) for water-proof purpose; and said middle frame section (31) further including: an inner sliding plate (34) secured to an inner side of the middle frame section (31) having sheath (341) and a restoring spring (342) formed on a free end portion of the inner sliding plate (34); and an outer sliding plate (35) secured to an outer side of the middle frame section (31) having spring retainer (352) formed on a free end portion (351) of the outer sliding plate (35) to be slidably engageble with the sheath (341) or the inner sliding plate (34), with the spring retainer (352) resiliently contacted with the restoring spring (342) for adjusting the width of the middle frame section (31) to conform with a size of the shoe (2) when engaged within the ajustable frame (3) and within the rim (111) of the sole retainer (11) of the jacket (1), with the restoring spring (342) operatively restoring the spring retainer (352) of the outer sliding plate (35) for resiliently holding the shoe (2) within the adjustable frame (3) and the rim (111) of the jacket (1).

2. A water-proof golf footwear according to claim 1, wherein said front rim (32) includes a pair of front spring legs (321) slidably engageable with two front sleeves (311) formed on two front ends of the middle frame section (31) for a sliding adjustment of the front portion of the adjustable frame (3); and the rear rim (33) including a pair of rear spring legs (331) slidably engageable with two rear sleeves (312) formed on two rear ends of the middle frame section (31) for a sliding adjustment of the rear portion of the adjustable frame (3) for snugly holding the shoe (2) within the adjustable frame (3) and the rim (111) of the jacket (1).

3. A water-proof golf footwear according to claim 2, wherein said adjustable frame (3) is secured in the rim (111) of the jacket (1) by adhesive, having a telescopic distance (3*a*) corresponding to a sliding stroke of the front spring leg (321) in the front sleeve (311) which is not coated with adhesive for allowing a sliding movement of the front spring leg (321) in the front sleeve (311), and having a rear telescopic distance (3*b*) corresponding to a sliding stroke of the rear spring leg (331) in the rear sleeve (312) which is not coated with adhesive for allowing such a sliding movement of the rear spring leg (331) in the rear sleeve (312).

4. A water-proof golf footwear according to claim 1 wherein said boot portion (18) is formed with at least a vent (181) for ventilation in the boot portion (18) for comforting a wearer's foot.

* * * * *